US009957470B2

(12) United States Patent
Tantawy et al.

(10) Patent No.: US 9,957,470 B2
(45) **Date of Patent: *May 1, 2018**

(54) SOLID FREE-FLOWING PARTICULATE LAUNDRY DETERGENT COMPOSITION

(71) Applicant: The Procter & Gamble Company, Cincinnati, OH (US)

(72) Inventors: Hossam Hassan Tantawy, Northumberland (GB); Adam Porter, Tyne & Wear (GB); Andre Chieffi, Tynemouth (GB); Jill Robyn Dorgan, Newcastle upon Tyne (GB); Anthony McMeekin, Northumberland (GB); Paul Anthony Gould, Newcastle upon Tyne (GB); William Alexander Caufield, Newcastle upon Tyne (GB)

(73) Assignee: The Procter & Gamble Company, Cincinnati, OH (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/084,506

(22) Filed: Mar. 30, 2016

(65) Prior Publication Data

US 2016/0289608 A1 Oct. 6, 2016

(30) Foreign Application Priority Data

Mar. 30, 2015 (EP) ..... 15161715

(51) Int. Cl.

| | |
|---|---|
| ***C11D 17/06*** | (2006.01) |
| ***C11D 1/12*** | (2006.01) |
| ***C11D 1/29*** | (2006.01) |
| ***C11D 3/08*** | (2006.01) |
| ***C11D 3/10*** | (2006.01) |
| ***C11D 3/12*** | (2006.01) |
| ***C11D 3/37*** | (2006.01) |
| ***C11D 3/40*** | (2006.01) |
| ***C11D 3/42*** | (2006.01) |
| ***C11D 11/02*** | (2006.01) |
| ***C11D 1/22*** | (2006.01) |

(52) U.S. Cl.

CPC ..... *C11D 3/42* (2013.01); *C11D 1/22* (2013.01); *C11D 1/29* (2013.01); *C11D 3/08* (2013.01); *C11D 3/10* (2013.01); *C11D 3/126* (2013.01); *C11D 3/378* (2013.01); *C11D 3/3761* (2013.01); *C11D 3/40* (2013.01); *C11D 11/02* (2013.01); *C11D 17/06* (2013.01)

(58) Field of Classification Search

None

See application file for complete search history.

(56) References Cited

U.S. PATENT DOCUMENTS

| | | | | |
|---|---|---|---|---|
| 3,157,633 | A | 11/1964 | Kuhn | |
| 3,927,044 | A | 12/1975 | Foster et al. | |
| 4,912,203 | A | 3/1990 | Kluger et al. | |
| 5,071,440 | A | 12/1991 | Hines et al. | |
| 5,352,604 | A | 10/1994 | Wilson et al. | |
| 6,162,781 | A * | 12/2000 | Buscan | B01D 19/0404 510/276 |
| 6,362,159 | B1 | 3/2002 | Aguadisch et al. | |
| 6,780,832 | B1 * | 8/2004 | Maeda | C08F 220/06 510/229 |
| 2002/0010105 | A1 | 1/2002 | Bacon et al. | |
| 2005/0113541 | A1 * | 5/2005 | Tsumori | C04B 24/2647 526/317.1 |
| 2005/0170997 | A1 | 8/2005 | Blyth et al. | |

(Continued)

FOREIGN PATENT DOCUMENTS

| | | | |
|---|---|---|---|
| DE | 10 2009 028507 | A1 | 2/2011 |
| EP | 2 801 606 | A1 | 11/2014 |

(Continued)

OTHER PUBLICATIONS

EP Search Report; Application No. 15161701.6-1357; dated Oct. 12, 2015; 7 pages.

(Continued)

*Primary Examiner* — Lorna M Douyon

(74) *Attorney, Agent, or Firm* — John T. Dipre; Steven W. Miller

(57) ABSTRACT

A solid free-flowing particulate laundry detergent composition comprising: (a) from 0.1 wt % to 5 wt % hueing agent particle comprising: (i) from 2 wt % to 10 wt % hueing agent, wherein the hueing agent has the following structure:

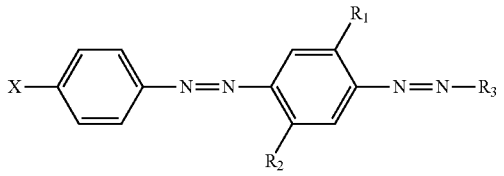

wherein:

R1 and R2 are independently selected from H; alkyl; alkoxy; alkyleneoxy; alkyl capped alkyleneoxy; urea; and amido;

R3 is a substituted aryl group;

X is a substituted group comprising sulfonamide moiety; and (ii) from 60 wt % to 98 wt % clay; and (b) from 35 wt % to 80 wt % spray-dried particle comprising: (a) from 8 wt % to 24 wt % alkyl benzene sulphonate anionic detersive surfactant; (b) from 5w % to 18 wt % silicate salt; (c) from 0 wt % to 10 wt % sodium carbonate; and (d) from 0 wt % to 5 wt % carboxylate polymer.

9 Claims, No Drawings

(56) References Cited

U.S. PATENT DOCUMENTS

| | | | | |
|---|---|---|---|---|
| 2006/0189501 | A1 | 8/2006 | Lant et al. | |
| 2008/0193999 | A1 | 8/2008 | Andersen et al. | |
| 2009/0105109 | A1 | 4/2009 | Lant et al. | |
| 2009/0172898 | A1 | 7/2009 | Kramer et al. | |
| 2009/0209661 | A1 | 8/2009 | Somerville Roberts et al. | |
| 2009/0286711 | A1* | 11/2009 | Somerville Roberts | C11D 3/046 510/351 |
| 2009/0318326 | A1 | 12/2009 | Lant | |
| 2009/0325846 | A1 | 12/2009 | Tantawy et al. | |
| 2009/0325847 | A1* | 12/2009 | Tantawy | C11D 3/0052 510/276 |
| 2010/0022431 | A1 | 1/2010 | Lant et al. | |
| 2010/0125047 | A1 | 5/2010 | Lant | |
| 2011/0237487 | A1 | 9/2011 | Souter et al. | |
| 2011/0245132 | A1* | 10/2011 | Dupont | C08F 216/14 510/357 |
| 2011/0245133 | A1* | 10/2011 | Dupont | C08F 290/062 510/357 |
| 2011/0257061 | A1 | 10/2011 | Blyth et al. | |
| 2012/0101018 | A1 | 4/2012 | Miracle et al. | |
| 2012/0231991 | A1* | 9/2012 | Mukherjee | C11D 3/0036 510/476 |
| 2012/0258507 | A1 | 10/2012 | Adams et al. | |
| 2012/0304402 | A1 | 12/2012 | Miracle et al. | |
| 2013/0150278 | A1 | 6/2013 | Magennis et al. | |
| 2013/0203644 | A1 | 8/2013 | Lant et al. | |
| 2013/0260438 | A1 | 10/2013 | Alekseyev et al. | |
| 2013/0303428 | A1 | 11/2013 | Fernandes et al. | |
| 2013/0303429 | A1 | 11/2013 | Stenger et al. | |
| 2013/0320575 | A1 | 12/2013 | Tantawy et al. | |
| 2013/0324452 | A1 | 12/2013 | Tantawy et al. | |
| 2013/0324454 | A1 | 12/2013 | Tantawy et al. | |
| 2014/0066353 | A1* | 3/2014 | Wang | C11D 3/42 510/299 |
| 2014/0073551 | A1 | 3/2014 | Mort, III et al. | |
| 2014/0162929 | A1 | 6/2014 | Labeque et al. | |
| 2014/0187468 | A1 | 7/2014 | Estell et al. | |
| 2014/0357542 | A1 | 12/2014 | Lant et al. | |
| 2014/0366281 | A1 | 12/2014 | Mort, III et al. | |
| 2015/0018263 | A1 | 1/2015 | Somerville Roberts et al. | |
| 2015/0132831 | A1 | 5/2015 | Olinski et al. | |
| 2016/0289597 | A1 | 10/2016 | Tantawy et al. | |
| 2016/0289598 | A1 | 10/2016 | Constable et al. | |
| 2016/0289599 | A1 | 10/2016 | Constable et al. | |
| 2016/0289600 | A1 | 10/2016 | Tantawy et al. | |
| 2016/0289604 | A1 | 10/2016 | Tantawy et al. | |
| 2016/0289607 | A1 | 10/2016 | Chieffi et al. | |
| 2016/0289609 | A1 | 10/2016 | Tantawy et al. | |
| 2016/0289610 | A1 | 10/2016 | Dorgan et al. | |
| 2016/0289611 | A1 | 10/2016 | Chieffi et al. | |
| 2016/0289612 | A1 | 10/2016 | Tantawy et al. | |
| 2016/0289616 | A1 | 10/2016 | Tantawy et al. | |

FOREIGN PATENT DOCUMENTS

| | | | |
|---|---|---|---|
| EP | 2 801 609 | A1 | 11/2014 |
| GB | 1 408 969 | A | 10/1975 |
| WO | WO 2008/087497 | A1 | 7/2008 |
| WO | WO 2009/158449 | A1 | 12/2009 |
| WO | WO 2011/061044 | A1 | 5/2011 |
| WO | WO 2012/134969 | A1 | 10/2012 |
| WO | WO2013/160093 | A1 | 10/2013 |

OTHER PUBLICATIONS

EP Search Report; Application No. 15161704.0/1357; dated Oct. 9, 2015; 6 pages.
EP Search Report; Application No. 15161706.5-1357; dated Oct. 6, 2015; 4 pages.
EP Search Report; Application No. 15161711.5-1357; dated Oct. 6, 2015; 4 pages.
International Search Report; International Application No. PCT/US2016/024817; dated Jun. 2, 2016; 11 pages.
EP Search Report; Application No. 15161718.0-1357; dated Oct. 9, 2015; 7 pages.
EP Search Report; Application No. 15161722.2-1357; dated Oct. 14, 2015; 4 pages.
International Search Report; International Application No. PCT/US2016/022788; dated Jun. 3, 2016; 11 pages.
EP Search Report; Application No. 15161728.9-1357; dated Oct. 9, 2015; 9 pages.
EP Search Report; Application No. 15162361.8-1357; dated Oct. 23, 2015; 7 pages.
EP Search Report; Application No. 15162357.6-1357; dated Oct. 26, 2015; 7 pages.
EP Search Report; Application No. 15162356.8-1357; dated Oct. 26, 2015; 8 pages.
U.S. Appl. No. 15/084,499, dated Mar. 30, 2016, Hossam Hassan Tantawy, et al.
U.S. Appl. No. 15/084,501, dated Mar. 30, 2016, Andrew Richard Constable, et al.
U.S. Appl. No. 15/084,502, dated Mar. 30, 2016, Andrew Richard Constable, et al.
U.S. Appl. No. 15/084,503, dated Mar. 30, 2016, Andre Chieffi, et al.
U.S. Appl. No. 15/084,507, dated Mar. 30, 2016, Hossam Hassan Tantawy, et al.
U.S. Appl. No. 15/084,510, dated Mar. 30, 2016, Hossam Hassan Tantawy, et al.
U.S. Appl. No. 15/084,513, dated Mar. 30, 2016, Hossam Hassan Tantawy, et al.
U.S. Appl. No. 15/084,516, dated Mar. 30, 2016, Hossam Hassan Tantawy, et al.
U.S. Appl. No. 15/088,163, dated Apr. 1, 2016, Jill Robyn Dorgan, et al.
U.S. Appl. No. 15/088,164, dated Apr. 1, 2016, Andre Chieffi, et al.
U.S. Appl. No. 15/088,165, dated Apr. 1, 2016, Hossam Hassan Tantawy, et al.

* cited by examiner

SOLID FREE-FLOWING PARTICULATE LAUNDRY DETERGENT COMPOSITION

FIELD OF THE INVENTION

The present invention relates to solid free-flowing particulate laundry detergent compositions. The compositions of the present invention comprise a hueing agent particle and a spray-dried particle. The compositions of the present invention exhibit excellent hueing performance and excellent surfactant performance. In particular, the compositions of the present invention exhibit more even distribution of hueing agent on the fabric surface, and also minimize undesirable spotting negatives.

BACKGROUND OF THE INVENTION

Laundry detergent powder manufacturers seek to provide products that have excellent whiteness and dingy cleaning performance. In order to meet this need, laundry detergent powder manufacturers incorporate ingredients such as hueing agents and detersive surfactants into their products. There are many different types of hueing agents and surfactants available to the laundry detergent manufacturer and there are a variety of different methods these ingredients can be incorporated into a laundry detergent powder product. Particular care needs to be taken when incorporating hueing agents into a laundry detergent powder product to ensure that good hueing performance is achieved. In particular, it is desirable to have an even distribution of hueing agent on the fabric surface. Furthermore, care must be taken to minimize any undesirable spotting negatives.

The inventors have found that the resultant whiteness and dingy cleaning performance of the laundry detergent powder depends not only on the combination of the type of hueing agent and the type of detersive surfactant incorporated, but also on the particle architecture of the hueing agent particle and the detersive surfactant particle.

The inventors have found that when this particle architecture is optimized as defined by the claims of the present invention, the whiteness and dingy cleaning performance of the laundry detergent powder product is improved. In addition, the inventors have found that this specific particle architecture also provides a more even distribution of hueing agent on the fabric surface and minimizes any undesirable spotting negatives.

SUMMARY OF THE INVENTION

The present invention relates to a solid free-flowing particulate laundry detergent composition comprising: (a) from 0.1 wt % to 5 wt % hueing agent particle comprising: (i) from 2 wt % to 10 wt % hueing agent, wherein the hueing agent has the following structure:

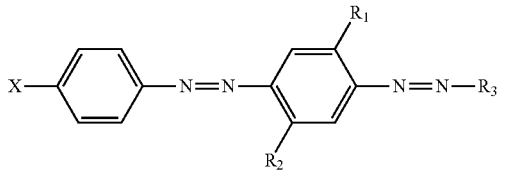

wherein: R1 and R2 are independently selected from the group consisting of: H; alkyl; alkoxy; alkyleneoxy; alkyl capped alkyleneoxy; urea; and amido; R3 is a substituted aryl group; X is a substituted group comprising sulfonamide moiety and optionally an alkyl and/or aryl moiety, and wherein the substituent group comprises at least one alkyleneoxy chain that comprises an average molar distribution of at least four alkyleneoxy moieties; and (ii) from 60 wt % to 98 wt % clay; (b) from 35 wt % to 80 wt % spray-dried particle comprising: (a) from 8 wt % to 24 wt % alkyl benzene sulphonate anionic detersive surfactant; (b) from 5 w % to 18 wt % silicate salt; (c) from 0 wt % to 10 wt % sodium carbonate; and (d) from 0 wt % to 5 wt % carboxylate polymer.

DETAILED DESCRIPTION OF THE INVENTION

Solid Free-Flowing Particulate Laundry Detergent Composition:

The solid free-flowing particulate laundry detergent composition comprises from 0.1 wt % to 5 wt %, preferably from 0.1 wt % to 2 wt % hueing agent particle, and from 35 wt % to 80 wt %, preferably from 35 wt % to 70 wt % or even from 40 wt % to 60 wt % spray-dried particle. The hueing agent particle and spray-dried particle are described in more detail below. The composition preferably comprises from 0.5 wt % to 20 wt %, preferably from 1 wt % to 10 wt % or even from 2 wt % to 5 wt % AES particle. The AES particle is described in more detail below. The composition may also comprise: from 1 wt % to 30 wt % LAS particle; from 0.1 wt % to 5 wt %, preferably from 0.5 wt % to 2 wt % polymer particle; and/or from 0.1 wt % to 5 wt %, preferably from 0.2 wt % to 2 wt % silicone particle. These particles are described in more detail below.

Preferably, the composition comprises: (a) from 0 wt % to 5 wt % zeolite builder; (b) from 0 wt % to 5 wt % phosphate builder; and (c) from 0 wt % to 5 wt % sodium carbonate.

Preferably, the composition comprises alkyl benzene sulphonate and ethoxylated alkyl sulphate in a weight ratio of from 5:1 to 20:1.

Typically, the solid free-flowing particulate laundry detergent composition is a fully formulated laundry detergent composition, not a portion thereof such as a spray-dried, extruded or agglomerate particle that only forms part of the laundry detergent composition. Typically, the solid composition comprises a plurality of chemically different particles, such as spray-dried base detergent particles and/or agglomerated base detergent particles and/or extruded base detergent particles, in combination with one or more, typically two or more, or five or more, or even ten or more particles selected from: surfactant particles, including surfactant agglomerates, surfactant extrudates, surfactant needles, surfactant noodles, surfactant flakes; phosphate particles; zeolite particles; silicate salt particles, especially sodium silicate particles; carbonate salt particles, especially sodium carbonate particles; polymer particles such as carboxylate polymer particles, cellulosic polymer particles, starch particles, polyester particles, polyamine particles, terephthalate polymer particles, polyethylene glycol particles; aesthetic particles such as coloured noodles, needles, lamellae particles and ring particles; enzyme particles such as protease granulates, amylase granulates, lipase granulates, cellulase granulates, mannanase granulates, pectate lyase granulates, xyloglucanase granulates, bleaching enzyme granulates and co-granulates of any of these enzymes, preferably these enzyme granulates comprise sodium sulphate; bleach particles, such as percarbonate particles, especially coated percarbonate particles, such as percarbonate coated with carbonate salt, sulphate salt, silicate salt, borosilicate salt, or any combination thereof, perborate particles, bleach activator particles such as tetra acetyl ethylene diamine particles and/or alkyl oxybenzene sulphonate particles, bleach catalyst particles such as transition metal catalyst particles, and/or isoquinolinium bleach catalyst particles, pre-formed peracid particles, especially coated pre-formed peracid particles; filler particles such as sulphate salt particles and chloride particles; clay particles such as montmorillonite particles and particles of clay and silicone; flocculant particles such as polyethylene oxide particles; wax particles such as wax agglomerates; silicone particles, brightener particles; dye transfer inhibition particles; dye fixative particles; perfume particles such as perfume microcapsules and starch encapsulated perfume accord particles, or pro-perfume particles such as Schiff base reaction product particles; hueing dye particles; chelant particles such as chelant agglomerates; and any combination thereof.

Spray-Dried Particle:

The spray-dried particle comprises: (a) from 8 wt % to 24 wt % alkyl benzene sulphonate anionic detersive surfactant; (b) from 5 w % to 18 wt % silicate salt; (c) from 0 wt % to 10 wt % sodium carbonate; and (d) from 0 wt % to 5 wt % carboxylate polymer.

Preferably, the spray-dried particle is free from sodium carbonate. Preferably, the spray-dried particle comprises sulphate salt, preferably sodium sulphate. Preferably, the spray-dried particle comprises from 54 wt % to 87 wt % sodium sulphate.

Preferably, the spray-dried particle comprises from 5 wt % to 18 wt % silicate salt, wherein the ratio of $SiO_2$:$Na_2O$ is in the range of from 1.6 to 2.35. It may be preferred that when the silicate salt has a low $SiO_2$:$Na_2O$ ratio, for example approximately 1.6, then the level of silicate salt present in the spray-dried particle is high, for example approximately 18 wt %. It may also be preferred than when the silicate has a high $SiO_2$:$Na_2O$ ratio, for example approximately 2.35, then the level of silicate salt present in the spray-dried particle is low, for example approximately 5 wt %.

Preferably, the spray-dried particle has a bulk density of from 350 g/l to 500 g/l. Typically, the spray-dried particle has a weight average particle size of from 400 micrometers to 450 micrometers. Typically, the spray-dried particle has a particle size distribution such that the geometric span is from 1.8 to 2.0.

Method of Making the Spray-Dried Particle:

The spray-dried particle is prepared by a spray-drying process. Typically, an aqueous mixture is prepared by contacting alkyl benzene sulphonate anionic detersive surfactant, silicate salt and water. If present, carboxylate polymer is then added to the aqueous mixture. Typically, sodium sulphate is then contacted to the aqueous mixture to form a crutcher mixture. Typically, the crutcher mixture comprises from 26 wt % to 32 wt % water. Typically, the crutcher mixture is then spray-dried to form the spray-dried particle.

LAS Particle:

The LAS particle comprises: (a) from 30 wt % to 50 wt % alkyl benzene sulphonate anionic detersive surfactant; and (b) from 50 wt % to 70 wt % salt, wherein the salt is a sodium salt and/or a carbonate salt. Preferably, the LAS particle comprises from 1 wt % to 5 wt % carboxylate polymer. The LAS particle can be an LAS agglomerate or an LAS spray-dried particle. Typically, the LAS spray-dried particle has a bulk density of from 300 g/l to 400 g/l.

Method of Making the LAS Particle:

The LAS particle is preferably prepared by either an agglomeration process or a spray-drying process.

Typically, the spray-drying process comprises the step of contacting alkyl benzene sulphonate anionic detersive surfactant and water to form an aqueous mixture. Preferably, if present the carboxylate polymer is then contacted with the aqueous mixture. Typically, salt is then contacted with the aqueous mixture to form a crutcher mixture. Typically, the crutcher mixture comprises at least 40 wt % water. This level of water in the crutcher is preferred, especially when the salt is sodium sulphate. This is because this level of water promotes good dissolution of the sodium sulphate in the crutcher mixture. Typically, the crutcher mixture is then spray-dried to form the LAS spray-dried particle.

Preferably, the inlet air temperature during the spray-drying step is 250° C. or lower. Controlling the inlet air temperature of the spray-drying step in this manner is important due to the thermal stability of the crutcher mixture due to the high organic level in the crutcher mixture.

The spray-drying step can be co-current or counter-current.

AES Particle:

The AES particle comprises: (a) from 40 wt % to 60 wt % partially ethoxylated alkyl sulphate anionic detersive surfactant, wherein the partially ethoxylated alkyl sulphate anionic detersive surfactant has a molar average degree of ethoxylation of from 0.8 to 1.2, and wherein the partially ethoxylated alkyl sulphate anionic detersive surfactant has a molar ethoxylation distribution such that: (i) from 40 wt % to 50 wt % is unethoxylated, having a degree of ethoxylation of 0; (ii) from 20 wt % to 30 wt % has a degree of ethoxylation of 1; (iii) from 20 wt % to 40 wt % has a degree of ethoxylation of 2 or greater; (b) from 20 wt % to 50 wt % salt, wherein the salt is selected from sulphate salt and/or carbonate salt; and (c) from 10 wt % to 30 wt % silica. Preferably, the weight ratio of partially ethoxylated alkyl sulphate anionic detersive surfactant to silica is from 1.3:1 to 6:1, preferably from 2:1 to 5:1. Preferably, the AES particle is in the form of an agglomerate.

Method of Making Partially Ethoxylated Alkyl Sulphate Anionic Detersive Surfactant:

Ethylene oxide and alkyl alcohol are reacted together to form ethoxylated alkyl alcohol, typically the molar ratio of ethylene oxide to alkyl alcohol used as the reaction substrates is in the range of from 0.8 to 1.2, preferably a stoichiometric ratio is used (a molar ratio of 1:1). Typically, a catalyst and alkyl alcohol are mixed together and dried using vacuum and heat (e.g. 100 mbar and 140° C.) to form an alcohol-catalyst. Typically, ethylene oxide (EO) is then slowly added to the dried alcohol-catalyst. Typically, after the EO is added dried alcohol-catalyst, the pH of the reaction mixture is reduced, e.g. by using lactic acid. Typically, acetic acid is then added to neutralize the reaction to form the ethoxylated alkyl alcohol.

Typically, the ethoxylated alkyl alcohol is sulphated in a falling film reactor with $SO_3$ to form a surfactant acid precursor, which is then neutralized with NaOH to form the ethoxylated alkyl sulphate anionic detersive surfactant (AES).

Typically, the molar ethoxylation distribution of AES is manipulated by controlling the molar ethoxylation distribution of the ethoxylated alcohol product during its synthesis. The catalyst for this reaction is preferably a base with a pKb≤5, more preferably with a pKb≤3, more preferably with a pKb≤1, most preferably with a pKb≤0.5. Preferred catalysts are KOH and NaOH. Typically, the choice of catalyst controls the molar ethoxylation distribution. Typically, stronger base catalysts will favor a broader molar ethoxylation distribution with higher levels of unethoxylated material and higher levels of ethoxylated materials having a degree of ethoxylation of 2 or greater. Typically, weaker base catalysts favor a narrower molar ethoxylation distribution with lower levels of unethoxylated alcohol and lower levels of ethoxylated material having a degree of ethoxylation of 2 or greater.

The molar ethoxylation distribution of the AES is typically determined by measuring the molecular weight distribution via mass spectrometry.

Method of Making the AES Particle:

Typically, AES particle is made by an agglomeration process. Typically, the partially ethoxylated alkyl sulphate anionic detersive surfactant, salt and silica are dosed into one or more mixers and agglomerated to form the AES particle.

Polymer Particle:

Typically, the polymer particle comprises: (a) from 60 wt % to 90 wt % co-polymer and (b) from 10 wt % to 40 wt % salt. Preferably, the co-polymer comprises: (i) from 50 to less than 98 wt % structural units derived from one or more monomers comprising carboxyl groups; (ii) from 1 to less than 49 wt % structural units derived from one or more monomers comprising sulfonate moieties; and (iii) from 1 to 49 wt % structural units derived from one or more types of monomers selected from ether bond-containing monomers represented by formulas (I) and (II):

formula (I)

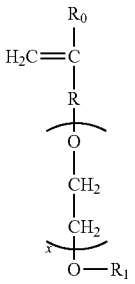

wherein in formula (I), $R_0$ represents a hydrogen atom or $CH_3$ group, R represents a $CH_2$ group, $CH_2CH_2$ group or single bond, X represents a number 0-5 provided X represents a number 1-5 when R is a single bond, and $R_1$ is a hydrogen atom or $C_1$ to $C_{20}$ organic group;

formula (II)

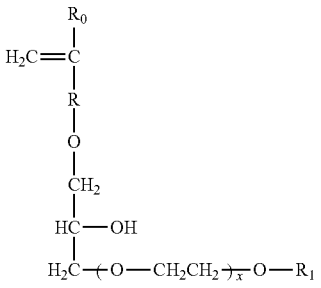

wherein in formula (II), $R_0$ represents a hydrogen atom or $CH_3$ group, R represents a $CH_2$ group, $CH_2CH_2$ group or single bond, X represents a number 0-5, and $R_1$ is a hydrogen atom or $C_1$ to $C_{20}$ organic group.

It may be preferred that the polymer has a weight average molecular weight of at least 50 kDa, or even at least 70 kDa.

Preferably, the salt is selected from sulphate salt and/or carbonate salt. A preferred salt is a sulphate salt, more preferably sodium sulphate. Preferably, the polymer particle is a spray-dried particle. Typically, the polymer particle has a bulk density of from 300 g/l to 500 g/l. Typically, the polymer particle has a weight average particle size in the range of from 300 micrometers to 500 micrometers. Typically, the particle size distribution of the polymer particle is such that the geometric span is from 1.8 to 2.0.

Method of Making the Polymer Particle:

Typically, the polymer particle is prepared by a spray-drying process. Preferably, the polymer is contacted to water to form an aqueous polymer mixture. Preferably, salt is then contacted to this aqueous polymer mixture to form a crutcher mixture. Preferably, the crutcher mixture comprises from 60 wt % to 80 wt % water. Preferably, the crutcher mixture is then spray dried to form the polymer particle. This order of addition ensures good dispersion of the polymer in the crutcher mixture, which in turn leads to good drying profile and good physical properties of the polymer particle, such as good cake strength profile.

Hueing Agent Particle:

The particle comprises: (a) from 2 wt % to 10 wt % hueing agent, wherein the hueing agent has the following structure:

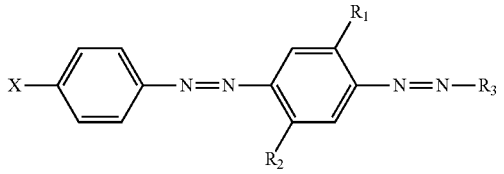

wherein: R1 and R2 are independently selected from the group consisting of: H; alkyl; alkoxy; alkyleneoxy; alkyl capped alkyleneoxy; urea; and amido; R3 is a substituted aryl group; X is a substituted group comprising sulfonamide moiety and optionally an alkyl and/or aryl moiety, and wherein the substituent group comprises at least one alkyleneoxy chain that comprises an average molar distribution of at least four alkyleneoxy moieties; and (b) from 60 wt % to 98 wt % clay. Preferably, the clay is a montmorillonite clay, also known as bentonite clay. Preferably, the particle comprises from 90 wt % to 98 wt % clay. It may also be preferred for the composition to comprise inorganic salts, such as sodium sulphate, preferably from 20 wt % to 38 wt % sodium sulphate.

Method of Making the Hueing Agent Particle:

The hueing agent particle can be prepared by an agglomeration process. Typically, the hueing agent and clay are dosed into one or more mixers and agglomerated to form the hueing agent agglomerate.

Silicone Particle:

The silicone particle comprises: (a) from 10 wt % to 20 wt % silicone; and (b) from 50 wt % to 80 wt % carrier. The carrier may be zeolite. The silicone particle may be in the form of an agglomerate.

Method of Making the Silicone Particle:

The silicone particle can be prepared by an agglomeration process. Typically, the silicone and carrier are dosed into one or more mixers and agglomerated to form the silicone agglomerate.

Detergent Ingredients:

Typically, suitable laundry detergent compositions comprise a detergent ingredient selected from: detersive surfactant, such as anionic detersive surfactants, non-ionic detersive surfactants, cationic detersive surfactants, zwitterionic detersive surfactants and amphoteric detersive surfactants; polymers, such as carboxylate polymers, soil release polymer, anti-redeposition polymers, cellulosic polymers and care polymers; bleach, such as sources of hydrogen peroxide, bleach activators, bleach catalysts and pre-formed peracids; photobleach, such as such as zinc and/or aluminium sulphonated phthalocyanine; enzymes, such as proteases, amylases, cellulases, lipases; zeolite builder; phosphate builder; co-builders, such as citric acid and citrate; carbonate, such as sodium carbonate and sodium bicarbonate; sulphate salt, such as sodium sulphate; silicate salt such as sodium silicate; chloride salt, such as sodium chloride; brighteners; chelants; hueing agents; dye transfer inhibitors; dye fixative agents; perfume; silicone; fabric softening agents, such as clay; flocculants, such as polyethyleneoxide; suds suppressors; and any combination thereof.

Detersive Surfactant:

Suitable detersive surfactants include anionic detersive surfactants, non-ionic detersive surfactant, cationic detersive surfactants, zwitterionic detersive surfactants and amphoteric detersive surfactants. Suitable detersive surfactants may be linear or branched, substituted or un-substituted, and may be derived from petrochemical material or biomaterial.

Anionic Detersive Surfactant:

Suitable anionic detersive surfactants include sulphonate and sulphate detersive surfactants.

Suitable sulphonate detersive surfactants include methyl ester sulphonates, alpha olefin sulphonates, alkyl benzene sulphonates, especially alkyl benzene sulphonates, preferably $C_{10-13}$ alkyl benzene sulphonate. Suitable alkyl benzene sulphonate (LAS) is obtainable, preferably obtained, by sulphonating commercially available linear alkyl benzene (LAB); suitable LAB includes low 2-phenyl LAB, other suitable LAB include high 2-phenyl LAB, such as those supplied by Sasol under the tradename Hyblene®.

Suitable sulphate detersive surfactants include alkyl sulphate, preferably $C_{8-18}$ alkyl sulphate, or predominantly $C_{12}$ alkyl sulphate.

A preferred sulphate detersive surfactant is alkyl alkoxylated sulphate, preferably alkyl ethoxylated sulphate, preferably a $C_{8-18}$ alkyl alkoxylated sulphate, preferably a $C_{8-18}$ alkyl ethoxylated sulphate, preferably the alkyl alkoxylated sulphate has an average degree of alkoxylation of from 0.5 to 20, preferably from 0.5 to 10, preferably the alkyl alkoxylated sulphate is a $C_{8-18}$ alkyl ethoxylated sulphate having an average degree of ethoxylation of from 0.5 to 10, preferably from 0.5 to 5, more preferably from 0.5 to 3 and most preferably from 0.5 to 1.5.

The alkyl sulphate, alkyl alkoxylated sulphate and alkyl benzene sulphonates may be linear or branched, substituted or un-substituted, and may be derived from petrochemical material or biomaterial.

Other suitable anionic detersive surfactants include alkyl ether carboxylates.

Suitable anionic detersive surfactants may be in salt form, suitable counter-ions include sodium, calcium, magnesium, amino alcohols, and any combination thereof. A preferred counter-ion is sodium.

Non-Ionic Detersive Surfactant:

Suitable non-ionic detersive surfactants are selected from the group consisting of: $C_8$-$C_{18}$ alkyl ethoxylates, such as, NEODOL® non-ionic surfactants from Shell; $C_6$-$C_{12}$ alkyl phenol alkoxylates wherein preferably the alkoxylate units are ethyleneoxy units, propyleneoxy units or a mixture thereof; $C_{12}$-$C_{18}$ alcohol and $C_6$-$C_{12}$ alkyl phenol condensates with ethylene oxide/propylene oxide block polymers such as Pluronic® from BASF; alkylpolysaccharides, preferably alkylpolyglycosides; methyl ester ethoxylates; polyhydroxy fatty acid amides; ether capped poly(oxyalkylated) alcohol surfactants; and mixtures thereof.

Suitable non-ionic detersive surfactants are alkylpolyglucoside and/or an alkyl alkoxylated alcohol.

Suitable non-ionic detersive surfactants include alkyl alkoxylated alcohols, preferably $C_{8-18}$ alkyl alkoxylated alcohol, preferably a $C_{8-18}$ alkyl ethoxylated alcohol, preferably the alkyl alkoxylated alcohol has an average degree of alkoxylation of from 1 to 50, preferably from 1 to 30, or from 1 to 20, or from 1 to 10, preferably the alkyl alkoxylated alcohol is a $C_{8-18}$ alkyl ethoxylated alcohol having an average degree of ethoxylation of from 1 to 10, preferably from 1 to 7, more preferably from 1 to 5 and most preferably from 3 to 7. The alkyl alkoxylated alcohol can be linear or branched, and substituted or un-substituted.

Suitable nonionic detersive surfactants include secondary alcohol-based detersive surfactants.

Cationic Detersive Surfactant:

Suitable cationic detersive surfactants include alkyl pyridinium compounds, alkyl quaternary ammonium compounds, alkyl quaternary phosphonium compounds, alkyl ternary sulphonium compounds, and mixtures thereof.

Preferred cationic detersive surfactants are quaternary ammonium compounds having the general formula:

$$(R)(R_1)(R_2)(R_3)N^+X^-$$

wherein, R is a linear or branched, substituted or unsubstituted $C_{6-18}$ alkyl or alkenyl moiety, $R_1$ and $R_2$ are independently selected from methyl or ethyl moieties, $R_3$ is a hydroxyl, hydroxymethyl or a hydroxyethyl moiety, X is an anion which provides charge neutrality, preferred anions include: halides, preferably chloride; sulphate; and sulphonate.

Zwitterionic Detersive Surfactant:

Suitable zwitterionic detersive surfactants include amine oxides and/or betaines.

Polymer:

Suitable polymers include carboxylate polymers, soil release polymers, anti-redeposition polymers, cellulosic polymers, care polymers and any combination thereof.

Carboxylate Polymer:

The composition may comprise a carboxylate polymer, such as a maleate/acrylate random copolymer or polyacrylate homopolymer. Suitable carboxylate polymers include: polyacrylate homopolymers having a molecular weight of from 4,000 Da to 9,000 Da; maleate/acrylate random copolymers having a molecular weight of from 50,000 Da to 100,000 Da, or from 60,000 Da to 80,000 Da.

Another suitable carboxylate polymer is a co-polymer that comprises: (i) from 50 to less than 98 wt % structural units derived from one or more monomers comprising carboxyl groups; (ii) from 1 to less than 49 wt % structural units derived from one or more monomers comprising sulfonate moieties; and (iii) from 1 to 49 wt % structural units derived from one or more types of monomers selected from ether bond-containing monomers represented by formulas (I) and (II):

formula (I)

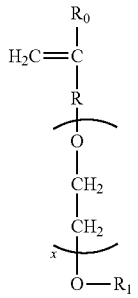

wherein in formula (I), $R_0$ represents a hydrogen atom or $CH_3$ group, R represents a $CH_2$ group, $CH_2CH_2$ group or single bond, X represents a number 0-5 provided X represents a number 1-5 when R is a single bond, and $R_1$ is a hydrogen atom or $C_1$ to $C_{20}$ organic group;

formula (II)

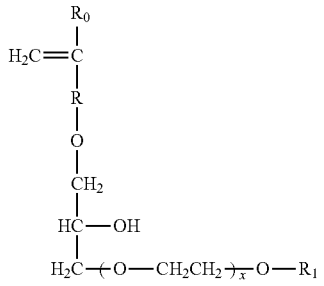

wherein in formula (II), $R_0$ represents a hydrogen atom or $CH_3$ group, R represents a $CH_2$ group, $CH_2CH_2$ group or single bond, X represents a number 0-5, and $R_1$ is a hydrogen atom or $C_1$ to $C_{20}$ organic group.

It may be preferred that the polymer has a weight average molecular weight of at least 50 kDa, or even at least 70 kDa.

Soil release polymer: The composition may comprise a soil release polymer. A suitable soil release polymer has a structure as defined by one of the following structures (I), (II) or (III):

$$—[(OCHR^1—CHR^2)_a—O—OC—Ar—CO—]_d \quad (I)$$

$$—[(OCHR^3—CHR^4)_b—O—OC\text{-}sAr—CO—]_e \quad (II)$$

$$—[(OCHR^5—CHR^6)_c—OR^7]_f \quad (III)$$

wherein:

a, b and c are from 1 to 200;

d, e and f are from 1 to 50;

Ar is a 1,4-substituted phenylene;

sAr is 1,3-substituted phenylene substituted in position 5 with $SO_3Me$;

Me is Li, K, Mg/2, Ca/2, Al/3, ammonium, mono-, di-, tri-, or tetraalkylammonium wherein the alkyl groups are $C_1$-$C_{18}$ alkyl or $C_2$-$C_{10}$ hydroxyalkyl, or mixtures thereof;

$R^1$, $R^2$, $R^3$, $R^4$, $R^5$ and $R^6$ are independently selected from H or $C_1$-$C_{18}$ n- or iso-alkyl; and $R^7$ is a linear or branched $C_1$-$C_{18}$ alkyl, or a linear or branched $C_2$-$C_{30}$ alkenyl, or a cycloalkyl group with 5 to 9 carbon atoms, or a $C_8$-$C_{30}$ aryl group, or a $C_6$-$C_{30}$ arylalkyl group.

Suitable soil release polymers are sold by Clariant under the TexCare® series of polymers, e.g. TexCare® SRN240 and TexCare® SRA300. Other suitable soil release polymers are sold by Solvay under the Repel-o-Tex® series of polymers, e.g. Repel-o-Tex® SF2 and Repel-o-Tex® Crystal.

Anti-Redeposition Polymer:

Suitable anti-redeposition polymers include polyethylene glycol polymers and/or polyethyleneimine polymers.

Suitable polyethylene glycol polymers include random graft co-polymers comprising: (i) hydrophilic backbone comprising polyethylene glycol; and (ii) hydrophobic side chain(s) selected from the group consisting of: $C_4$-$C_{25}$ alkyl group, polypropylene, polybutylene, vinyl ester of a saturated $C_1$-$C_6$ mono-carboxylic acid, $C_1$-$C_6$ alkyl ester of acrylic or methacrylic acid, and mixtures thereof. Suitable polyethylene glycol polymers have a polyethylene glycol backbone with random grafted polyvinyl acetate side chains. The average molecular weight of the polyethylene glycol backbone can be in the range of from 2,000 Da to 20,000 Da, or from 4,000 Da to 8,000 Da. The molecular weight ratio of the polyethylene glycol backbone to the polyvinyl acetate side chains can be in the range of from 1:1 to 1:5, or from 1:1.2 to 1:2. The average number of graft sites per ethylene oxide units can be less than 1, or less than 0.8, the average number of graft sites per ethylene oxide units can be in the range of from 0.5 to 0.9, or the average number of graft sites per ethylene oxide units can be in the range of from 0.1 to 0.5, or from 0.2 to 0.4. A suitable polyethylene glycol polymer is Sokalan HP22. Suitable polyethylene glycol polymers are described in WO08/007320.

Cellulosic Polymer:

Suitable cellulosic polymers are selected from alkyl cellulose, alkyl alkoxyalkyl cellulose, carboxyalkyl cellulose, alkyl carboxyalkyl cellulose, sulphoalkyl cellulose, more preferably selected from carboxymethyl cellulose, methyl cellulose, methyl hydroxyethyl cellulose, methyl carboxymethyl cellulose, and mixtures thereof.

Suitable carboxymethyl celluloses have a degree of carboxymethyl substitution from 0.5 to 0.9 and a molecular weight from 100,000 Da to 300,000 Da.

Suitable carboxymethyl celluloses have a degree of substitution greater than 0.65 and a degree of blockiness greater than 0.45, e.g. as described in WO09/154933.

Care Polymers:

Suitable care polymers include cellulosic polymers that are cationically modified or hydrophobically modified. Such modified cellulosic polymers can provide anti-abrasion benefits and dye lock benefits to fabric during the laundering cycle. Suitable cellulosic polymers include cationically modified hydroxyethyl cellulose.

Other suitable care polymers include dye lock polymers, for example the condensation oligomer produced by the condensation of imidazole and epichlorhydrin, preferably in ratio of 1:4:1. A suitable commercially available dye lock polymer is Polyquart® FDI (Cognis).

Other suitable care polymers include amino-silicone, which can provide fabric feel benefits and fabric shape retention benefits.

Bleach:

Suitable bleach includes sources of hydrogen peroxide, bleach activators, bleach catalysts, pre-formed peracids and any combination thereof. A particularly suitable bleach includes a combination of a source of hydrogen peroxide with a bleach activator and/or a bleach catalyst.

Source of Hydrogen Peroxide:

Suitable sources of hydrogen peroxide include sodium perborate and/or sodium percarbonate.

Bleach Activator:

Suitable bleach activators include tetra acetyl ethylene diamine and/or alkyl oxybenzene sulphonate.

Bleach Catalyst:

The composition may comprise a bleach catalyst. Suitable bleach catalysts include oxaziridinium bleach catalysts, transition metal bleach catalysts, especially manganese and iron bleach catalysts. A suitable bleach catalyst has a structure corresponding to general formula below:

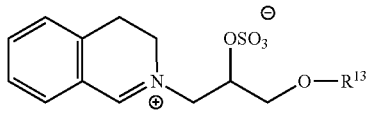

wherein $R^{13}$ is selected from the group consisting of 2-ethylhexyl, 2-propylheptyl, 2-butyloctyl, 2-pentylnonyl, 2-hexyldecyl, n-dodecyl, n-tetradecyl, n-hexadecyl, n-octadecyl, iso-nonyl, iso-decyl, iso-tridecyl and iso-pentadecyl.

Pre-Formed Peracid:

Suitable pre-form peracids include phthalimido-peroxycaproic acid.

Enzymes:

Suitable enzymes include lipases, proteases, cellulases, amylases and any combination thereof.

Protease:

Suitable proteases include metalloproteases and/or serine proteases. Examples of suitable neutral or alkaline proteases include: subtilisins (EC 3.4.21.62); trypsin-type or chymotrypsin-type proteases; and metalloproteases. The suitable proteases include chemically or genetically modified mutants of the aforementioned suitable proteases.

Suitable commercially available protease enzymes include those sold under the trade names Alcalase®, Savinase®, Primase®, Durazym®, Polarzyme®, Kannase®, Liquanase®, Liquanase Ultra®, Savinase Ultra®, Ovozyme®, Neutrase®, Everlase® and Esperase® by Novozymes A/S (Denmark), those sold under the tradename Maxatase®, Maxacal®, Maxapem®, Preferenz P® series of proteases including Preferenz® P280, Preferenz® P281, Preferenz® P2018-C, Preferenz® P2081-WE, Preferenz® P2082-EE and Preferenz® P2083-A/J, Properase®, Purafect®, Purafect Prime®, Purafect Ox®, FN3®, FN4®, Excellase® and Purafect OXP® by DuPont, those sold under the tradename Opticlean® and Optimase® by Solvay Enzymes, those available from Henkel/Kemira, namely BLAP (sequence shown in FIG. 29 of U.S. Pat. No. 5,352,604 with the following mutations S99D+S101 R+S103A+V104I+G159S, hereinafter referred to as BLAP), BLAP R (BLAP with S3T+V4I+V199M+V205I+L217D), BLAP X (BLAP with S3T+V4I+V205I) and BLAP F49 (BLAP with S3T+V4I+A194P+V199M+V205+L217D)—all from Henkel/Kemira; and KAP (*Bacillus alkalophilus* subtilisin with mutations A230V+S256G+S259N) from Kao.

A suitable protease is described in WO11/140316 and WO11/072117.

Amylase:

Suitable amylases are derived from AA560 alpha amylase endogenous to *Bacillus* sp. DSM 12649, preferably having the following mutations: R118K, D183*, G184*, N195F, R320K, and/or R458K. Suitable commercially available amylases include Stainzyme®, Stainzyme® Plus, Natalase, Termamyl®, Termamyl® Ultra, Liquezyme® SZ, Duramyl®, Everest® (all Novozymes) and Spezyme® AA, Preferenz S® series of amylases, Purastar® and Purastar® Ox Am, Optisize® HT Plus (all Du Pont).

A suitable amylase is described in WO06/002643.

Cellulase:

Suitable cellulases include those of bacterial or fungal origin. Chemically modified or protein engineered mutants are also suitable. Suitable cellulases include cellulases from the genera *Bacillus, Pseudomonas, Humicola, Fusarium, Thielavia, Acremonium*, e.g., the fungal cellulases produced from *Humicola insolens, Myceliophthora thermophila* and *Fusarium oxysporum.*

Commercially available cellulases include Celluzyme®, Carezyme®, and Carezyme® Premium, Celluclean® and Whitezyme® (Novozymes A/S), Revitalenz® series of enzymes (Du Pont), and Biotouch® series of enzymes (AB Enzymes). Suitable commercially available cellulases include Carezyme® Premium, Celluclean® Classic. Suitable cellulases are described in WO07/144857 and WO10/056652.

Lipase:

Suitable lipases include those of bacterial, fungal or synthetic origin, and variants thereof. Chemically modified or protein engineered mutants are also suitable. Examples of suitable lipases include lipases from *Humicola* (synonym *Thermomyces*), e.g., from *H. lanuginosa* (*T. lanuginosus*).

The lipase may be a "first cycle lipase", e.g. such as those described in WO06/090335 and WO13/116261. In one aspect, the lipase is a first-wash lipase, preferably a variant of the wild-type lipase from *Thermomyces* lanuginosus comprising T231R and/or N233R mutations. Preferred lipases include those sold under the tradenames Lipex®, Lipolex® and Lipoclean® by Novozymes, Bagsvaerd, Denmark.

Other suitable lipases include: Liprl 139, e.g. as described in WO2013/171241; and TfuLip2, e.g. as described in WO2011/084412 and WO2013/033318.

Other Enzymes:

Other suitable enzymes are bleaching enzymes, such as peroxidases/oxidases, which include those of plant, bacterial or fungal origin and variants thereof. Commercially available peroxidases include Guardzyme® (Novozymes A/S). Other suitable enzymes include choline oxidases and perhydrolases such as those used in Gentle Power Bleach™.

Other suitable enzymes include pectate lyases sold under the tradenames X-Pect®, Pectaway® (from Novozymes A/S, Bagsvaerd, Denmark) and PrimaGreen® (DuPont) and mannanases sold under the tradenames Mannaway® (Novozymes A/S, Bagsvaerd, Denmark), and Mannastar® (Du Pont).

Zeolite Builder:

The composition may comprise zeolite builder. The composition may comprise from 0 wt % to 5 wt % zeolite builder, or 3 wt % zeolite builder. The composition may even be substantially free of zeolite builder; substantially free means "no deliberately added". Typical zeolite builders include zeolite A, zeolite P and zeolite MAP.

Phosphate Builder:

The composition may comprise phosphate builder. The composition may comprise from 0 wt % to 5 wt % phosphate builder, or to 3 wt %, phosphate builder. The composition may even be substantially free of phosphate builder; substantially free means "no deliberately added". A typical phosphate builder is sodium tri-polyphosphate.

Carbonate Salt:

The composition may comprise carbonate salt. The composition may comprise from 0 wt % to 10 wt % carbonate salt, or to 5 wt % carbonate salt. The composition may even be substantially free of carbonate salt; substantially free means "no deliberately added". Suitable carbonate salts include sodium carbonate and sodium bicarbonate.

Silicate Salt:

The composition may comprise silicate salt. The composition may comprise from 0 wt % to 10 wt % silicate salt, or to 5 wt % silicate salt. A preferred silicate salt is sodium silicate, especially preferred are sodium silicates having a $Na_2O:SiO_2$ ratio of from 1.0 to 2.8, preferably from 1.6 to 2.0.

Sulphate Salt:

A suitable sulphate salt is sodium sulphate.

Brightener:

Suitable fluorescent brighteners include: di-styryl biphenyl compounds, e.g. Tinopal® CBS-X, di-amino stilbene di-sulfonic acid compounds, e.g. Tinopal® DMS pure Xtra and Blankophor® HRH, and Pyrazoline compounds, e.g. Blankophor® SN, and coumarin compounds, e.g. Tinopal® SWN.

Preferred brighteners are: sodium 2 (4-styryl-3-sulfophenyl)-2H-napthol[1,2-d]triazole, disodium 4,4'-bis{[(4-anilino-6-(N methyl-N-2 hydroxyethyl)amino 1,3,5-triazin-2-yl)]; amino}stilbene-2-2' disulfonate, disodium 4,4'-bis{[(4-anilino-6-morpholino-1,3,5-triazin-2-yl)]amino}stilbene-2-2' disulfonate, and disodium 4,4'-bis(2-sulfostyryl)biphenyl. A suitable fluorescent brightener is C.I. Fluorescent Brightener 260, which may be used in its beta or alpha crystalline forms, or a mixture of these forms.

Chelant:

The composition may also comprise a chelant selected from: diethylene triamine pentaacetate, diethylene triamine penta(methyl phosphonic acid), ethylene diamine-N'N'-disuccinic acid, ethylene diamine tetraacetate, ethylene diamine tetra(methylene phosphonic acid) and hydroxyethane di(methylene phosphonic acid). A preferred chelant is ethylene diamine-N'N'-disuccinic acid (EDDS) and/or hydroxyethane diphosphonic acid (HEDP). The composition preferably comprises ethylene diamine-N'N'-disuccinic acid or salt thereof. Preferably the ethylene diamine-N'N'-disuccinic acid is in S,S enantiomeric form. Preferably the composition comprises 4,5-dihydroxy-m-benzenedisulfonic acid disodium salt. Preferred chelants may also function as calcium carbonate crystal growth inhibitors such as: 1-hydroxyethanediphosphonic acid (HEDP) and salt thereof; N,N-dicarboxymethyl-2-aminopentane-1,5-dioic acid and salt thereof; 2-phosphonobutane-1,2,4-tricarboxylic acid and salt thereof; and combination thereof.

Hueing Agent:

Suitable hueing agents include small molecule dyes, typically falling into the Colour Index (C.I.) classifications of Acid, Direct, Basic, Reactive (including hydrolysed forms thereof) or Solvent or Disperse dyes, for example classified as Blue, Violet, Red, Green or Black, and provide the desired shade either alone or in combination. Preferred such hueing agents include Acid Violet 50, Direct Violet 9, 66 and 99, Solvent Violet 13 and any combination thereof.

Many hueing agents are known and described in the art which may be suitable for the present invention, such as hueing agents described in WO2014/089386.

Suitable hueing agents include phthalocyanine and azo dye conjugates, such as described in WO2009/069077.

Suitable hueing agents may be alkoxylated. Such alkoxylated compounds may be produced by organic synthesis that may produce a mixture of molecules having different degrees of alkoxylation. Such mixtures may be used directly to provide the hueing agent, or may undergo a purification step to increase the proportion of the target molecule. Suitable hueing agents include alkoxylated bis-azo dyes, such as described in WO2012/054835, and/or alkoxylated thiophene azo dyes, such as described in WO2008/087497 and WO2012/166768.

The hueing agent may be incorporated into the detergent composition as part of a reaction mixture which is the result of the organic synthesis for a dye molecule, with optional purification step(s). Such reaction mixtures generally comprise the dye molecule itself and in addition may comprise un-reacted starting materials and/or by-products of the organic synthesis route. Suitable hueing agents can be incorporated into hueing dye particles, such as described in WO 2009/069077.

Dye Transfer Inhibitors:

Suitable dye transfer inhibitors include polyamine N-oxide polymers, copolymers of N-vinylpyrrolidone and N-vinylimidazole, polyvinylpyrrolidone, polyvinyloxazolidone, polyvinylimidazole and mixtures thereof. Preferred are poly (vinyl pyrrolidone), poly(vinylpyridine betaine), poly(vinylpyridine N-oxide), poly(vinyl pyrrolidone-vinyl imidazole) and mixtures thereof. Suitable commercially available dye transfer inhibitors include PVP-K15 and K30 (Ashland), Sokalan® HP165, HP50, HP53, HP59, HP56K, HP56, HP66 (BASF), Chromabond® S-400, S403E and S-100 (Ashland).

Perfume:

Suitable perfumes comprise perfume materials selected from the group: (a) perfume materials having a C log P of less than 3.0 and a boiling point of less than 250° C. (quadrant 1 perfume materials); (b) perfume materials having a C log P of less than 3.0 and a boiling point of 250° C. or greater (quadrant 2 perfume materials); (c) perfume materials having a C log P of 3.0 or greater and a boiling point of less than 250° C. (quadrant 3 perfume materials); (d) perfume materials having a C log P of 3.0 or greater and a boiling point of 250° C. or greater (quadrant 4 perfume materials); and (e) mixtures thereof.

It may be preferred for the perfume to be in the form of a perfume delivery technology. Such delivery technologies further stabilize and enhance the deposition and release of perfume materials from the laundered fabric. Such perfume delivery technologies can also be used to further increase the longevity of perfume release from the laundered fabric. Suitable perfume delivery technologies include: perfume microcapsules, pro-perfumes, polymer assisted deliveries, molecule assisted deliveries, fiber assisted deliveries, amine assisted deliveries, cyclodextrin, starch encapsulated accord, zeolite and other inorganic carriers, and any mixture thereof. A suitable perfume microcapsule is described in WO2009/101593.

Silicone:

Suitable silicones include polydimethylsiloxane and amino-silicones. Suitable silicones are described in WO05075616.

Process for Making the Solid Composition:

Typically, the particles of the composition can be prepared by any suitable method. For example: spray-drying, agglomeration, extrusion and any combination thereof.

Typically, a suitable spray-drying process comprises the step of forming an aqueous slurry mixture, transferring it through at least one pump, preferably two pumps, to a pressure nozzle.

Atomizing the aqueous slurry mixture into a spray-drying tower and drying the aqueous slurry mixture to form spray-dried particles. Preferably, the spray-drying tower is a counter-current spray-drying tower, although a co-current spray-drying tower may also be suitable.

Typically, the spray-dried powder is subjected to cooling, for example an air lift. Typically, the spray-drying powder is subjected to particle size classification, for example a sieve, to obtain the desired particle size distribution. Preferably, the spray-dried powder has a particle size distribution such that weight average particle size is in the range of from 300 micrometers to 500 micrometers, and less than 10 wt % of the spray-dried particles have a particle size greater than 2360 micrometers.

It may be preferred to heat the aqueous slurry mixture to elevated temperatures prior to atomization into the spray-drying tower, such as described in WO2009/158162.

It may be preferred for anionic surfactant, such as linear alkyl benzene sulphonate, to be introduced into the spray-drying process after the step of forming the aqueous slurry mixture: for example, introducing an acid precursor to the aqueous slurry mixture after the pump, such as described in WO 09/158449.

It may be preferred for a gas, such as air, to be introduced into the spray-drying process after the step of forming the aqueous slurry, such as described in WO2013/181205.

It may be preferred for any inorganic ingredients, such as sodium sulphate and sodium carbonate, if present in the aqueous slurry mixture, to be micronized to a small particle size such as described in WO2012/134969.

Typically, a suitable agglomeration process comprises the step of contacting a detersive ingredient, such as a detersive surfactant, e.g. linear alkyl benzene sulphonate (LAS) and/or alkyl alkoxylated sulphate, with an inorganic material, such as sodium carbonate and/or silica, in a mixer. The agglomeration process may also be an in-situ neutralization agglomeration process wherein an acid precursor of a detersive surfactant, such as LAS, is contacted with an alkaline material, such as carbonate and/or sodium hydroxide, in a mixer, and wherein the acid precursor of a detersive surfactant is neutralized by the alkaline material to form a detersive surfactant during the agglomeration process.

Other suitable detergent ingredients that may be agglomerated include polymers, chelants, bleach activators, silicones and any combination thereof.

The agglomeration process may be a high, medium or low shear agglomeration process, wherein a high shear, medium shear or low shear mixer is used accordingly. The agglomeration process may be a multi-step agglomeration process wherein two or more mixers are used, such as a high shear mixer in combination with a medium or low shear mixer. The agglomeration process can be a continuous process or a batch process.

It may be preferred for the agglomerates to be subjected to a drying step, for example to a fluid bed drying step. It may also be preferred for the agglomerates to be subjected to a cooling step, for example a fluid bed cooling step.

Typically, the agglomerates are subjected to particle size classification, for example a fluid bed elutriation and/or a sieve, to obtain the desired particle size distribution. Preferably, the agglomerates have a particle size distribution such that weight average particle size is in the range of from 300 micrometers to 800 micrometers, and less than 10 wt % of the agglomerates have a particle size less than 150 micrometers and less than 10 wt % of the agglomerates have a particle size greater than 1200 micrometers.

It may be preferred for fines and over-sized agglomerates to be recycled back into the agglomeration process. Typically, over-sized particles are subjected to a size reduction step, such as grinding, and recycled back into an appropriate place in the agglomeration process, such as the mixer. Typically, fines are recycled back into an appropriate place in the agglomeration process, such as the mixer.

It may be preferred for ingredients such as polymer and/or non-ionic detersive surfactant and/or perfume to be sprayed onto base detergent particles, such as spray-dried base detergent particles and/or agglomerated base detergent particles. Typically, this spray-on step is carried out in a tumbling drum mixer.

Method of Laundering Fabric:

The method of laundering fabric comprises the step of contacting the solid composition to water to form a wash liquor, and laundering fabric in said wash liquor. Typically, the wash liquor has a temperature of above 0° C. to 90° C., or to 60° C., or to 40° C., or to 30° C., or to 20° C. The fabric may be contacted to the water prior to, or after, or simultaneous with, contacting the solid composition with water. Typically, the wash liquor is formed by contacting the laundry detergent to water in such an amount so that the concentration of laundry detergent composition in the wash liquor is from 0.2 g/l to 20 g/l, or from 0.5 g/l to 10 g/l, or to 5.0 g/l. The method of laundering fabric can be carried out in a front-loading automatic washing machine, top loading automatic washing machines, including high efficiency automatic washing machines, or suitable hand-wash vessels. Typically, the wash liquor comprises 90 liters or less, or 60 liters or less, or 15 liters or less, or 10 liters or less of water. Typically, 200 g or less, or 150 g or less, or 100 g or less, or 50 g or less of laundry detergent composition is contacted to water to form the wash liquor.

Dimensions:

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Documents:

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

Embodiments

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

EXAMPLES

Example 1

The following samples were prepared by the processes described below. Sample 2 is in accordance with the present invention. Sample 1 comprises a comparative spray dried particle sample (comparative example). The below samples have equal anionic detersive surfactant levels.

| Ingredient | Sample 1 Comparative sample | Sample 2 In accordance with the present invention |
|---|---|---|
| Comparative spray dried particle (particle 1) | 13.4 g | 0 g |
| Inventive spray dried particle (particle 2) | 0 g | 16.6 g |
| Hueing particle (particle 3) | 0.4 g | 0.4 g |

Spray-Dried Particle Compositions:

The following spray-dried particle were prepared:

| Ingredient | Comparative spray dried particle (particle1) wt % | Inventive spray dried particle (particle 2) wt % |
|---|---|---|
| Hydroxyethane diphosphonic acid (HEDP) | 1.03 | 0 |
| Linear alkyl benzene sulphonate | 18.53 | 15 |
| Non-ionic detersive surfactant | 2.15 | 0 |
| Polyacrylate | 3.28 | 0 |
| Sodium carbonate | 16.35 | 0 |
| Sodium silicate 1.6R | 11.02 | 11.25 |
| Sodium sulphate | 41.66 | 72.75 |
| Polyethylene glycol polymer comprising polyvinyl acetate side chains | 1.71 | 0 |
| Water | 2.57 | 1 |
| Misc | 1.7 | 0 |

Particle 3. A Hueing Agent Particle and Process of Making it:

501.8 g of sodium bentonite (SPV 200) powder substrate (supplied by MTI) was weighed into the bowl of the food mixer (Philips HR7626-S/N). The lid of the mixer was locked in place and paraffin film was stretched over the inlet. 19.8 g of liquid hueing agent was weighed in a syringe and a hole was punctured in the paraffin film to allow the syringe through. The mixer was switched onto the maximum speed and the hueing agent was gradually added via the syringe. Once all of the hueing agent was added, it was allowed to mix for 2 minutes. The mixer was switched off, any agglomerated material on the blade was scraped back into the mixer and then mixed for an additional 2 minutes to produce the final material.

Hueing Agent Particle Composition:

| Ingredient | % w/w hueing agent particle |
|---|---|
| Sodium bentonite | 96.204 |
| Hueing agent in accordance with the structure given in claim 1 | 3.796 |

Example 2. Determination of Spotting on Treated Fabrics 500 ml of tap water was placed in a plastic bowl. A 12×12 cm swatch of Knitted Cotton (supplied by Equest) was placed into the bottom of the bowl. The sample was poured into the water and agitated with a metal spatula at the surface of the fabric for 30 seconds. The bowl was left standing for 30 minutes. The swatch was removed and rinsed by dipping in a bucket of clean tap water for 30 seconds. The swatch was left to dry overnight on a bench on silver foil.

Visual grading of the swatches was completed the following day. 9 panelists compared 3 replicate fabrics treated with samples 1 and 2 for the frequency of spotting using a grading scale such that a delta of 0 is "there is no difference", a delta of 1 is "there is a small but noticeable difference", a delta of 2 is "there a difference" and a delta of 3 is "there a big difference".

Results:

The average delta between replicate fabrics treated with sample 1 (comparative example) compared to sample 2 (sample in accordance with the present invention) was +1.7 (i.e. significantly less spotting for replicate fabrics treated with sample 2 (sample in accordance with the present invention) compared to replicate fabrics treated with sample 1 (comparative example).

Example 3. Solid Free-Flowing Particulate Laundry Detergent Composition Illustrative Examples

| Ingredient | Amount (in wt %) |
|---|---|
| Anionic detersive surfactant (such as alkyl benzene sulphonate, alkyl ethoxylated sulphate and mixtures thereof) | from 8 wt % to 15 wt % |
| Non-ionic detersive surfactant (such as alkyl ethoxylated alcohol) | from 0.1 wt % to 4 wt % |
| Cationic detersive surfactant (such as quaternary ammonium compounds) | from 0 wt % to 4 wt % |
| Other detersive surfactant (such as zwiterionic detersive surfactants, amphoteric surfactants and mixtures thereof) | from 0 wt % to 4 wt % |
| Carboxylate polymer (such as co-polymers of maleic acid and acrylic acid and/or carboxylate polymers comprising ether moieties and sulfonate moieties) | from 0.1 wt % to 4 wt % |
| Polyethylene glycol polymer (such as a polyethylene glycol polymer comprising polyvinyl acetate side chains) | from 0 wt % to 4 wt % |
| Polyester soil release polymer (such as Repel-o-tex and/or Texcare polymers) | from 0 wt % to 2 wt % |
| Cellulosic polymer (such as carboxymethyl cellulose, methyl cellulose and combinations thereof) | from 0.5 wt % to 2 wt % |
| Other polymer (such as care polymers) | from 0 wt % to 4 wt % |
| Zeolite builder and phosphate builder (such as zeolite 4A and/or sodium tripolyphosphate) | from 0 wt % to 4 wt % |
| Other co-builder (such as sodium citrate and/or citric acid) | from 0 wt % to 3 wt % |
| Carbonate salt (such as sodium carbonate and/or sodium bicarbonate) | from 0 wt % to 20 wt % |
| Silicate salt (such as sodium silicate) | from 0 wt % to 10 wt % |

-continued

| Ingredient | Amount (in wt %) |
|---|---|
| Filler (such as sodium sulphate and/or bio-fillers) | from 10 wt % to 70 wt % |
| Source of hydrogen peroxide (such as sodium percarbonate) | from 0 wt % to 20 wt % |
| Bleach activator (such as tetraacetylethylene diamine (TAED) and/or nonanoyloxybenzenesulphonate (NOBS)) | from 0 wt % to 8 wt % |
| Bleach catalyst (such as oxaziridinium-based bleach catalyst and/or transition metal bleach catalyst) | from 0 wt % to 0.1 wt % |
| Other bleach (such as reducing bleach and/or pre-formed peracid) | from 0 wt % to 10 wt % |
| Photobleach (such as zinc and/or aluminium sulphonated phthalocyanine) | from 0 wt % to 0.1 wt % |
| Chelant (such as ethylenediamine-N'N'-disuccinic acid (EDDS) and/or hydroxyethane diphosphonic acid (HEDP)) | from 0.2 wt % to 1 wt % |
| Hueing agent (such as direct violet 9, 66, 99, acid red 50, solvent violet 13 and any combination thereof) | from 0 wt % to 1 wt % |
| Brightener (C.I. fluorescent brightener 260 or C.I. fluorescent brightener 351) | from 0.1 wt % to 0.4 wt % |
| Protease (such as Savinase, Savinase Ultra, Purafect, FN3, FN4 and any combination thereof) | from 0.1 wt % to 0.4 wt % |
| Amylase (such as Termamyl, Termamyl ultra, Natalase, Optisize, Stainzyme, Stainzyme Plus and any combination thereof) | from 0 wt % to 0.2 wt % |
| Cellulase (such as Carezyme and/or Celluclean) | from 0 wt % to 0.2 wt % |
| Lipase (such as Lipex, Lipolex, Lipoclean and any combination thereof) | from 0 wt % to 1 wt % |
| Other enzyme (such as xyloglucanase, cutinase, pectate lyase, mannanase, bleaching enzyme) | from 0 wt % to 2 wt % |
| Fabric softener (such as montmorillonite clay and/or polydimethylsiloxane (PDMS)) | from 0 wt % to 15 wt % |
| Flocculant (such as polyethylene oxide) | from 0 wt % to 1 wt % |
| Suds suppressor (such as silicone and/or fatty acid) | from 0 wt % to 4 wt % |
| Perfume (such as perfume microcapsule, spray-on perfume, starch encapsulated perfume accords, perfume loaded zeolite, and any combination thereof) | from 0.1 wt % to 1 wt % |
| Aesthetics (such as coloured soap rings and/or coloured speckles/noodles) | from 0 wt % to 1 wt % |
| Miscellaneous | balance to 100 wt % |

The above solid free-flowing particulate laundry detergent illustrative examples can be prepared such that the particle architecture of the detergent comprises:

| Particle | Wt % |
|---|---|
| AES particle | from 0.5% to 20% |
| Silicone particle | from 0.1% to 5% |
| Spray-dried particle | from 35% to 80% |
| LAS particle | from 1% to 30% |
| Hueing particle | from 0.1% to 5% |
| Polymer particle | from 0.1% to 5% |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

The invention claimed is:

1. A solid free-flowing particulate laundry detergent composition comprising:

(a) from about 0.1 wt % to about 5 wt % hueing agent particle comprising:

(i) from about 2 wt % to about 10 wt % hueing agent, wherein the hueing agent has the following structure:

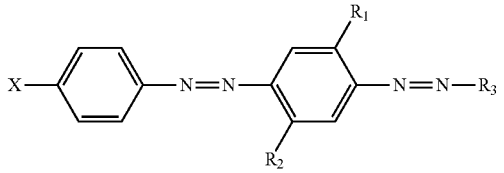

wherein:

$R_1$ and $R_2$ are independently selected from the group consisting of: H; alkyl; alkoxy; alkyleneoxy; alkyl capped alkyleneoxy; urea; and amido;

$R_3$ is a substituted aryl group;

X is a substituted group comprising sulfonamide moiety and optionally an alkyl and/or aryl moiety, and wherein the substituent group comprises at least one alkyleneoxy chain that comprises an average molar distribution of at least about four alkyleneoxy moieties; and (ii) from about 60 wt % to about 98 wt % clay; and (b) from about 35 wt % to about 80 wt % spray-dried particle comprising:

(a) from about 8 wt % to about 24 wt % alkyl benzene sulphonate anionic detersive surfactant;

(b) from about 5 w % to about 18 wt % silicate salt;

(c) from 0 wt % to 10 wt % sodium carbonate; and (d) from 0 wt % to 5 wt % carboxylate polymer; and (c) from about 0.1 wt % to about 5 wt % polymer particle comprising:

(i) from about 70 wt % to about 90 wt % co-polymer, wherein the co-polymer comprises:

(i.i) from about 50 to less than about 98 wt % structural units derived from one or more monomers comprising carboxyl groups;

(i.ii) from about 1 to less than about 49 wt % structural units derived from one or more monomers comprising sulfonate moieties; and (i.iii) from about 1 to about 49 wt % structural units derived from one or more types of monomers selected from ether bond-containing monomers represented by formulas (I) and (II):

formula (I)

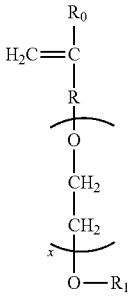

wherein in formula (I), $R_0$ represents a hydrogen atom or $CH_3$ group, R represents a $CH_2$ group, $CH_2CH_2$ group or single bond, X represents a number 0-5 provided X represents a number 1-5 when R is a single bond, and $R_1$ is a hydrogen atom or $C_1$ to $C_{20}$ organic group;

formula (II)

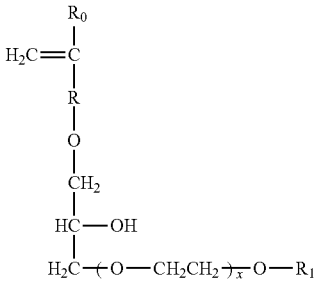

wherein in formula (II), $R_0$ represents a hydrogen atom or $CH_3$ group, R represents a $CH_2$ group, $CH_2CH_2$ group or single bond, X represents a number 0-5, and $R_1$ is a hydrogen atom or $C_1$ to $C_{20}$ organic group; and (ii) from about 10 wt % to about 30 wt % salt, wherein the salt is selected from sulphate salt and/or carbonate salt.

2. A composition according to claim 1, wherein the composition comprises from about 0.5 wt % to about 20 wt % ethoxylated alkyl sulphate particle comprising: (i) from about 40 wt % to about 60 wt % partially ethoxylated alkyl sulphate anionic detersive surfactant, wherein the partially ethoxylated alkyl sulphate anionic detersive surfactant has a molar average degree of ethoxylation of from about 0.8 to about 1.2, and wherein the partially ethoxylated alkyl sulphate anionic detersive surfactant has a molar ethoxylation distribution such that: (i.i) from about 40 wt % to about 50 wt % is unethoxylated; (i.ii) from about 20 wt % to about 30 wt % has a degree of ethoxylation of 1; (i.iii) from about 20 wt % to about 40 wt % has a degree of ethoxylation of about 2 or greater; (ii) from about 20 wt % to about 50 wt % salt, wherein the salt is selected from sulphate salt and/or carbonate salt; and (iii) from about 10 wt % to about 30 wt % silica.

3. A composition according to claim 1, wherein the composition comprises from about 1 wt % to about 30 wt % linear alkyl benzene sulphonate particle comprising:

(a) from about 30 wt % to about 50 wt % alkyl benzene sulphonate anionic detersive surfactant; and (b) from about 50 wt % to about 70 wt % salt, wherein the salt is a sodium salt and/or a carbonate salt.

4. A composition according to claim 1, wherein the composition comprises from about 0.1 wt % to about 5 wt % silicone particle comprising:

(a) from about 10 wt % to about 20 wt % silicone; and (b) from about 50 wt % to about 80 wt % carrier.

5. A composition according to claim 1, wherein the composition is substantially free of zeolite builder, phosphate builder and sodium carbonate.

6. A composition according to claim 1, wherein the hueing agent particle comprises montmorillonite clay.

7. A composition according to claim 1, wherein the spray-dried particle further comprises from about 54 wt % to about 87 wt % sodium sulphate.

8. A composition according to claim 2, wherein the ethoxylated alkyl sulphate particle comprises from about 20 wt % to about 50 wt % sodium sulphate.

9. A composition according to claim 2, wherein the weight ratio of partially ethoxylated alkyl sulphate anionic detersive surfactant to silica present in the ethoxylated alkyl sulphate particle is in the range of from about 2:1 to about 5:1.

* * * * *